US006135176A

United States Patent [19]

Smith

[11] Patent Number: 6,135,176

[45] Date of Patent: Oct. 24, 2000

[54] INFEED SIDE CHIPPER DRIVE ASSEMBLY FOR PIVOTABLE GANG SAW

[75] Inventor: Greg F. Smith, Portland, Oreg.

[73] Assignee: Timber Machine Technologies, Inc., Tualatin, Oreg.

[21] Appl. No.: 09/327,976

[22] Filed: Jun. 8, 1999

Related U.S. Application Data

[60] Provisional application No. 60/123,588, Mar. 10, 1999.

[51] Int. Cl.[7] ..... B27C 9/00; B27M 1/08

[52] U.S. Cl. ..... 144/39; 144/3.1; 144/357; 144/369

[58] Field of Search ..... 144/3.1, 39, 41, 144/356, 357, 367, 369

[56] References Cited

U.S. PATENT DOCUMENTS

| | | | |
|---|---|---|---|
| 4,485,861 | 12/1984 | Nilsson et al. | 144/39 |
| 5,396,938 | 3/1995 | Cannaday | 144/39 |
| 5,722,474 | 3/1998 | Raybon et al. | 144/3.1 |
| 5,765,615 | 6/1998 | Chapman | 144/39 |
| 5,816,302 | 10/1998 | Newnes | 144/357 |

OTHER PUBLICATIONS

Pantograph arm system of Ronald McGehee (1997).

*Primary Examiner*—W. Donald Bray

*Attorney, Agent, or Firm*—Marger Johnson & McCollom, P.C.

[57] ABSTRACT

Chipping heads are mounted for lateral movement in one dimension in a gang saw module which is itself moveable translationally in the first dimension and angularly in a second dimension, for skewing relative to an in-feed direction of a curved cant. The chipping heads are mounted on an in-feed side of the gang saw assembly. Stationary drive motors are mounted directly above the chipping heads, supported by a tower that is independent of the gang saw module. Vertical drive lines with U-joints drivingly connect the drive motors to the chipping heads while permitting the chipping heads to be moved normal to the axes of rotation of the drive motors. The motors are centered above the chipping heads, with their vertical drive axes midway between lateral endpoints in each dimension of the range of travel of the chipping heads. Motor spacing above the chipping heads and the drive line lengths are sufficient to accommodate that range of lateral travel. The chipping heads can move both with the saw module and laterally within it, independently of the stationary motors over an approximately oval area, to chip opposite sides of curved cants during in-feed for curve sawing.

4 Claims, 4 Drawing Sheets

INFEED SIDE CHIPPER DRIVE ASSEMBLY FOR PIVOTABLE GANG SAW

RELATED APPLICATION DATA

This application claims priority from inventor's provisional application, U.S. application Ser. No. 60/123,588, filed Mar. 10, 1999, for INFEED SIDE CHIPPER DRIVE ASSEMBLY FOR PIVOTABLE GANG SAW.

BACKGROUND OF THE INVENTION

This invention relates to gang sawing and chipping systems, and more particularly to such systems in which the gang saw is movable in two dimensions to saw a curved cant according to its curvature.

U.S. Pat. No. 5,722,474 to Raybon et al (incorporated herein by reference) discloses a method and apparatus for cutting a curved cant into boards. A scanner detects curvature of the cant and this information is used to control the position of a gang saw mounted on a pivot axis to cut the cant into substantially even thickness boards while moving the cant past the saws and pivoting the gang saw to accommodate the curvature of the cant.

Raybon et al have in-feed and out-feed conveyors positioned on opposite sides to a pivotable gang saw structure, and FIG. 7 shows chipping heads mounted in the out-feed conveyor assembly to remove the wane slabs from lateral sides of the sawn cant. The chipping heads are movable laterally to accommodate different dimensions of cants, and are driven from a pair of motors mounted atop the out-feed conveyor assembly via U-jointed drive shafts. The out-feed conveyor assembly is static, in contrast to the laterally pivotable gang saw assembly, so the chipping head drive need only accommodate movement of the chipping heads in one direction.

Using an out-feed chipping arrangement is disadvantageous for a number of reasons that make it preferable to perform the chipping operation before the cant is sawn rather afterward. It is known to use in-feed-side chipping heads in connection with a gang saw that is static or only laterally movable, with the chipping heads mounted in the infeed conveyor. This arrangement will not work, however, with a gang saw assembly that is movable in two dimensions as in the Raybon et al system. It is also impractical to try to mount the drive motors on the movable gang saw assembly because the gang saw assembly must be moved quite quickly from on position to another during sawing and the motors are too heavy to permit such quick movement.

One of the inventors named in Raybon et al, R. McGehee, has attempted to overcome this problem, by mounting the chipping heads in the entrance to the gang saw assembly to be movable in one lateral direction along rods and movable in a second direction along with the gang saw assembly. In order to provide drive power to the chipping head, the drive motors are mounted to one side of the outfeed frame assembly and coupled to the chipping heads through an articulating pantograph arm structure supporting a series belts and pulleys. This is a cumbersome, expensive and breakdown prone arrangement.

Accordingly, a better way is needed to provide in-feed-side chipping in a cant-sawing system having a gang saw that is pivotable or otherwise movable in two lateral dimensions.

SUMMARY OF THE INVENTION

The invention provides for mounting the chipping heads for lateral movement in one dimension in a gang saw assembly which is itself moveable in a second dimension, such as pivoting about a pivot point, or skewing relative to an infeed direction of a curved cant. The chipping heads are mounted on an infeed side of the gang saw assembly. Drive motors are mounted directly above the chipping heads, supported by a tower that is independent of the gang saw assembly. Drive power is transmitted from the motors to the chipping heads via drive lines that contain U-joints which permit the chipping heads to be moved in two dimensions in a plane normal to the axes of rotation of the drive motors. The motors are centered above a center position for the chipping heads, i.e. about midway between the lateral end-points in each dimension of the range of travel of the chipping heads. The motors are spaced a distance above the chipping head and the drive lines are sized to a length sufficient to accommodate that range of lateral travel. Therefore, the chipping heads can move both in one dimension across the gang saw assembly and transversely with the pivoting or skewing movement of the gang saw assembly in a second dimension, over an approximately oval area.

Further details of the arrangement and operation of the invention will be apparent from the accompanying drawings which show the curve sawing gang saw and in-feed chipping heads and overhead drive assembly of the present invention in various plan and elevation views. The drawings include labeling and dimensions of the various parts from which a person skilled in the art can readily discern how to make and use the invention in a preferred embodiment thereof.

The foregoing and other objects, features and advantages of the invention will become more readily apparent from the following detailed description of a preferred embodiment of the invention, which proceeds with reference to the accompanying drawings.

DETAILED DESCRIPTION

A gang saw and chipper apparatus 10 for in-feed-side chipping and curve sawing of cants is shown in FIGS. 1–4. Arrow 12 indicates the in-feed direction of a cant (not shown) and arrow 14 the outfeed direction.

Figure 2:
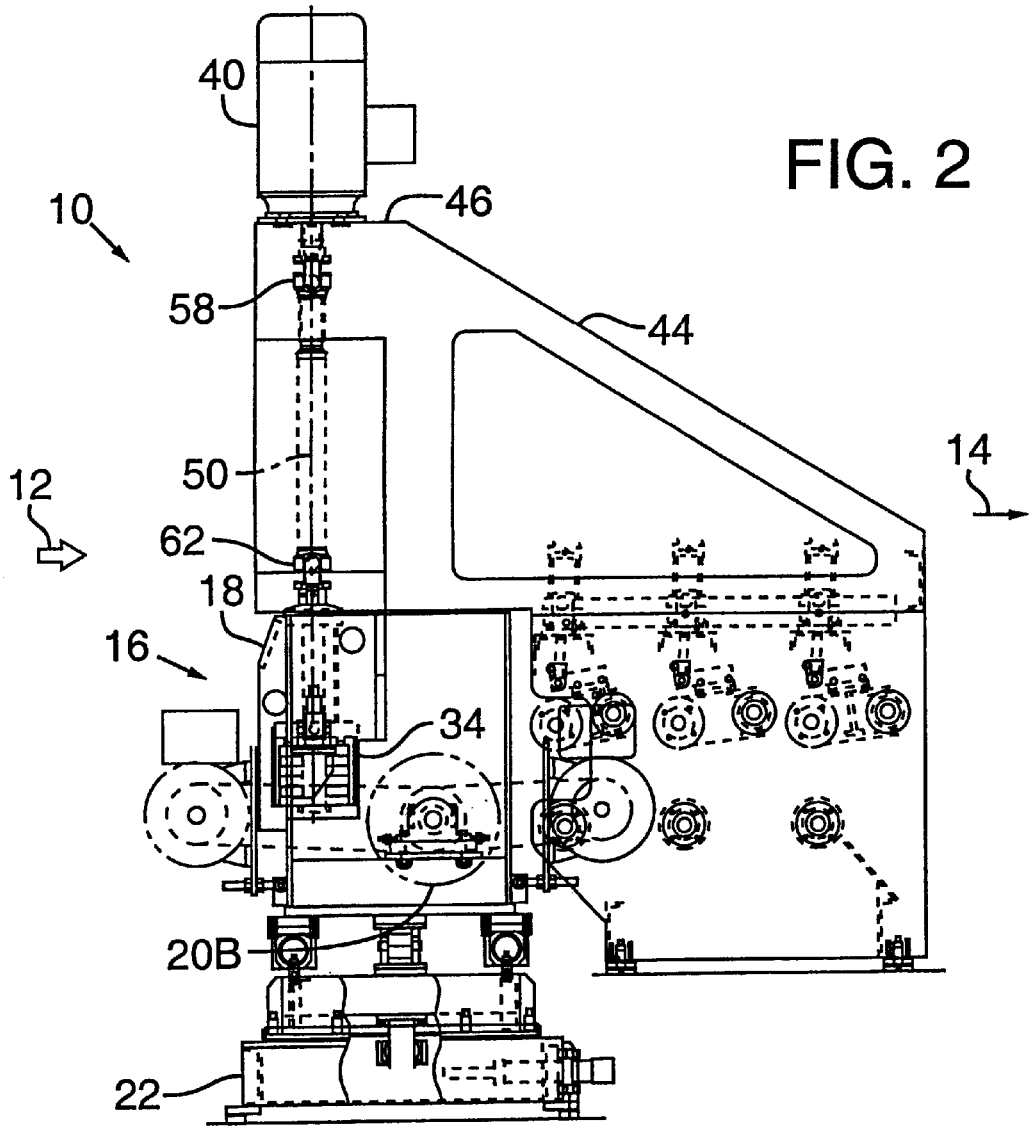
FIG. 2 is a right end elevation view of the apparatus of FIG. 1, in which an arrow labeled "flow" indicated the in-feed direction of a cant.

The gang saw assembly 16 includes a saw module 18 having an in-feed side and an outfeed side indicated by arrows 12, 14, a set of circular saws 20 in FIG. 2 (two sets 20A, 20B in FIG. 3) , and a support frame 22 and pivoting base 24 upon which the saw module is moveable. The saw module is movable translationally in a first dimension transversely of the infeed direction by a translation actuator or cylinder 26 and movable angularly in a second dimension by a skew actuator or cylinder 28 for skewing the saw module relative to the infeed direction of a curved cant. On the infeed side is an infeed section 30 and on the outfeed side is an outfeed section 32.

A pair of chipping heads 34, 36 mounted in the infeed side of the saw module 16 for translational movement transversely of the infeed direction within the module under control of actuators 35, 37 as well as angular and translational movement together with the saw module. Thus the chipper heads are subject of three components of movement; two translational and one angular. The chipping heads and actuators need to be arranged so that the can be repositioned quickly, unencumbered by inertia of their drives.

Driving the chipper heads 34, 36 are a pair of chipper drive motors 40, 42 mounted directly above the chipping heads. The motors are supported by a tower 44 independently of the saw module 16 and the infeed section 30. The tower is built into the outfeed section and comprises a generally triangular superstructure extending over the module 16 and supported from the outfeed section. The tower 44 includes a platform 46 positioned over the infeed side of the module to space the motors about a central position 48 between and above each of the chipping heads 34, 36. The platform is oriented so that the motors rotate about a vertical axes 50, 52. Each motor is thus fixedly positioned above a center position for the chipping heads with its vertical axis located about midway between lateral endpoints in each dimension of a defined range of travel of the respective chipping head.

A pair of drive lines 54, 56 each extend generally vertically between the motors and chipping heads. Each drive line drivingly couples a respective one of the motors to one of the chipping heads. Each drive line includes a top joint 58, 60, and a bottom joint 62, 64 arranged to permit compound angular travel of the chipping heads relative to the stationary motors for saw module skew and translation. The joints permit the chipping heads to be moved in two dimensions in a plane normal to the axes of rotation of the drive motors. Therefore, the chipping heads can move relative to the axes of the respective motors both in the first dimension with the saw module and transversely of the in-feed direction and in the second dimension with angular movement of the saw module. The motors are spaced a distance above the chipping heads and the drive lines are sized to a length sufficient to accommodate that range of lateral travel. The chipping heads can thereby be directly driven by the motors and quickly shifted within the saw module over an approximately oval area substantially unencumbered by the drive lines and motors. The direct drive of the chipping heads from stationary motors poised overhead has the advantages of simplicity, low cost, durable parts, resistance to breakdown, and ease of maintenance.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A gang saw and chipper apparatus for infeed-side chipping and curve sawing of cants, the apparatus comprising:

a gang saw assembly including a saw module having an infeed side and an outfeed side and a support frame upon which the saw module is moveable translationally in a first dimension and movable angularly in a second dimension for skewing the saw module relative to an infeed direction of a curved cant;

a pair of chipping heads mounted in the infeed side of the saw module for translational and angular movement therewith and moveably supported in the saw module for movement transversely of the infeed direction;

a pair of chipper drive motors mounted directly above the chipping heads, the motors supported by a tower independently of the saw module and positioned to rotate about a vertical axis;

a pair of drive lines, each extending vertically between and drivingly coupling one of the motors and one of the chipping heads;

the drive lines each including a joint which permits the chipping heads to be moved in two dimensions in a plane normal to the axes of rotation of the drive motors so that the chipping heads can move relative to the axes of the respective motors both in the first dimension with the saw module and transversely of the infeed direction and in the second dimension with angular movement of the saw module.

2. A gang saw and chipper apparatus according to claim 1 in which the motors are centered above a center position for the chipping heads, with each motor fixedly positioned with its vertical axis located about midway between lateral endpoints in each dimension of a defined range of travel of the respective chipping head.

3. A gang saw and chipper apparatus according to claim 1 in which the motors are spaced a distance above the chipping heads and the drive lines are sized to a length sufficient to accommodate that range of lateral travel.

4. A gang saw and chipper apparatus according to claim 1 in which the drive lines and joints permit the chipping heads to be moved over an approximately oval area and to be directly driven by the motors substantially unencumbered by the drive lines and motors.

* * * * *

UNITED STATES PATENT AND TRADEMARK OFFICE

CERTIFICATE OF CORRECTION

PATENT NO. : 6,135,176
DATED : October 24, 2000
INVENTOR(S) : Smith

It is certified that error appears in the above-identified patent and that said Letters Patent is hereby corrected as shown below:

Column 1,
Lines 57-58, "series belts" should read -- series of belts --

Figure 1:
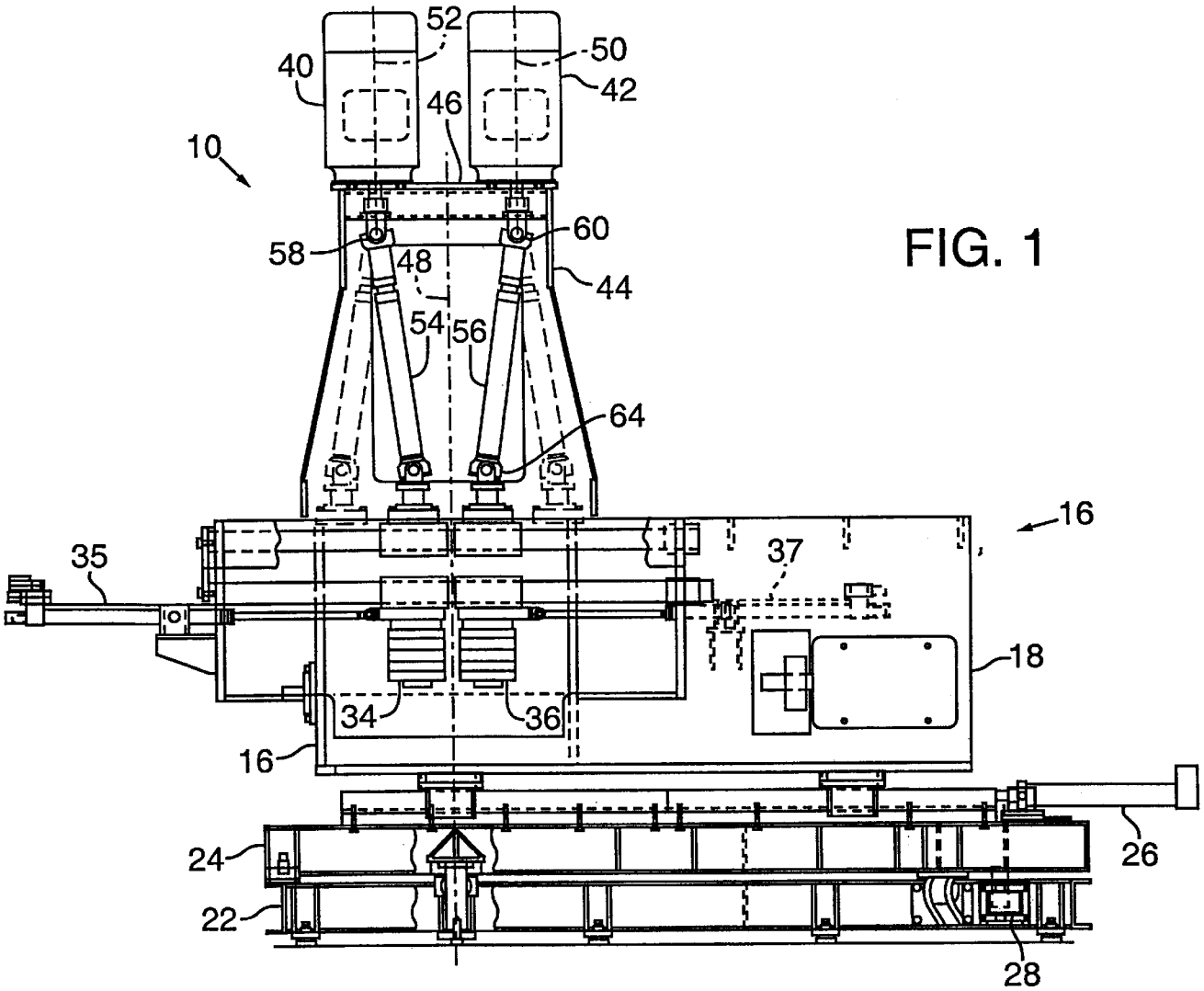
FIG. 1 is a side elevation view as seen from the in-feed side of a gang saw assembly with an in-feed-side chipping arrangement that is movable in two dimensions relative to the chipping head drive motors according to a preferred embodiment of the invention.
Figure 3:
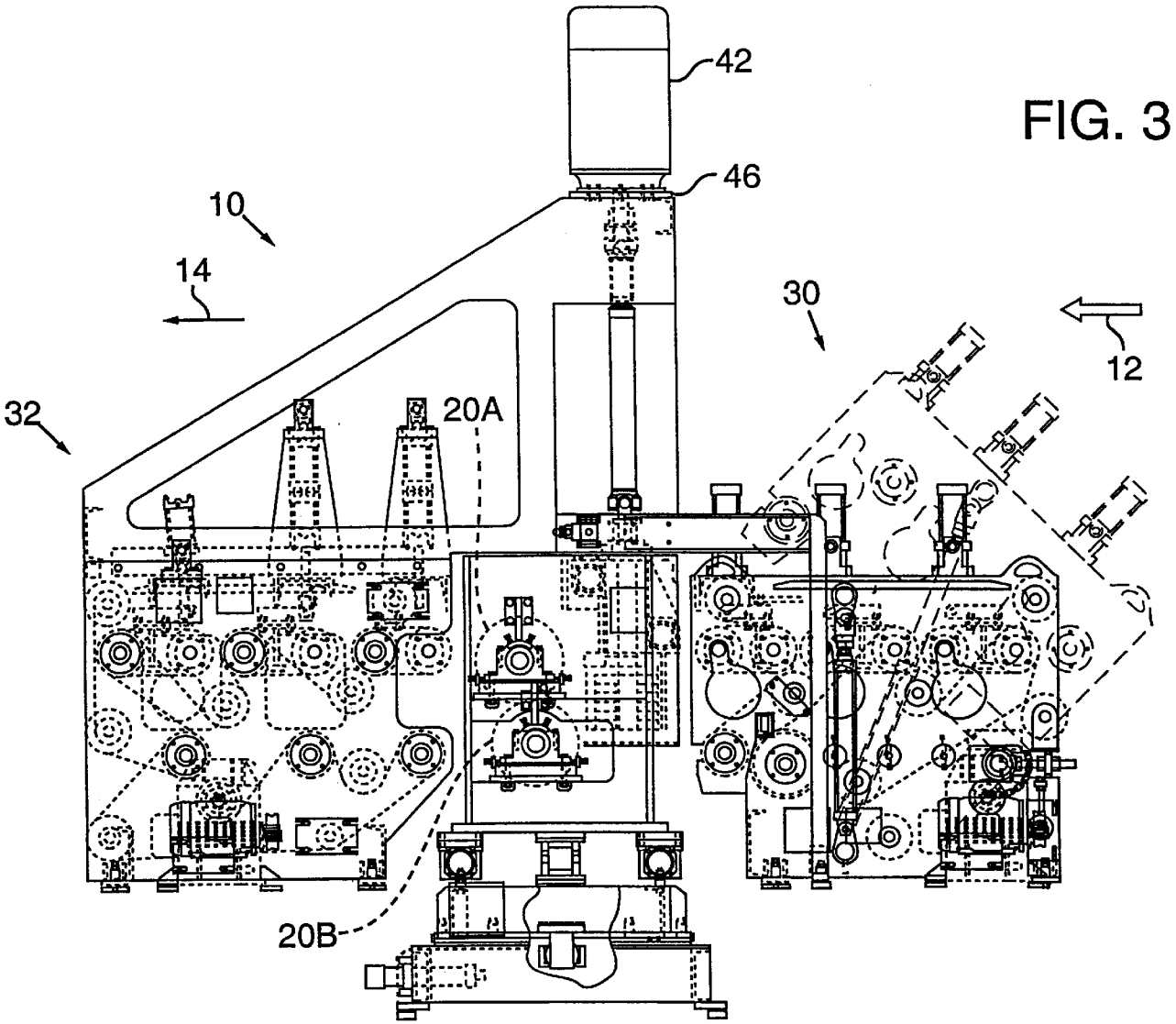
FIG. 3 is a left end elevation view of a dual-arbor version of the apparatus of FIGS. 1 and 2 in which the in-feed conveyor, omitted in FIGS. 1 and 2, is also shown.
Figure 4:
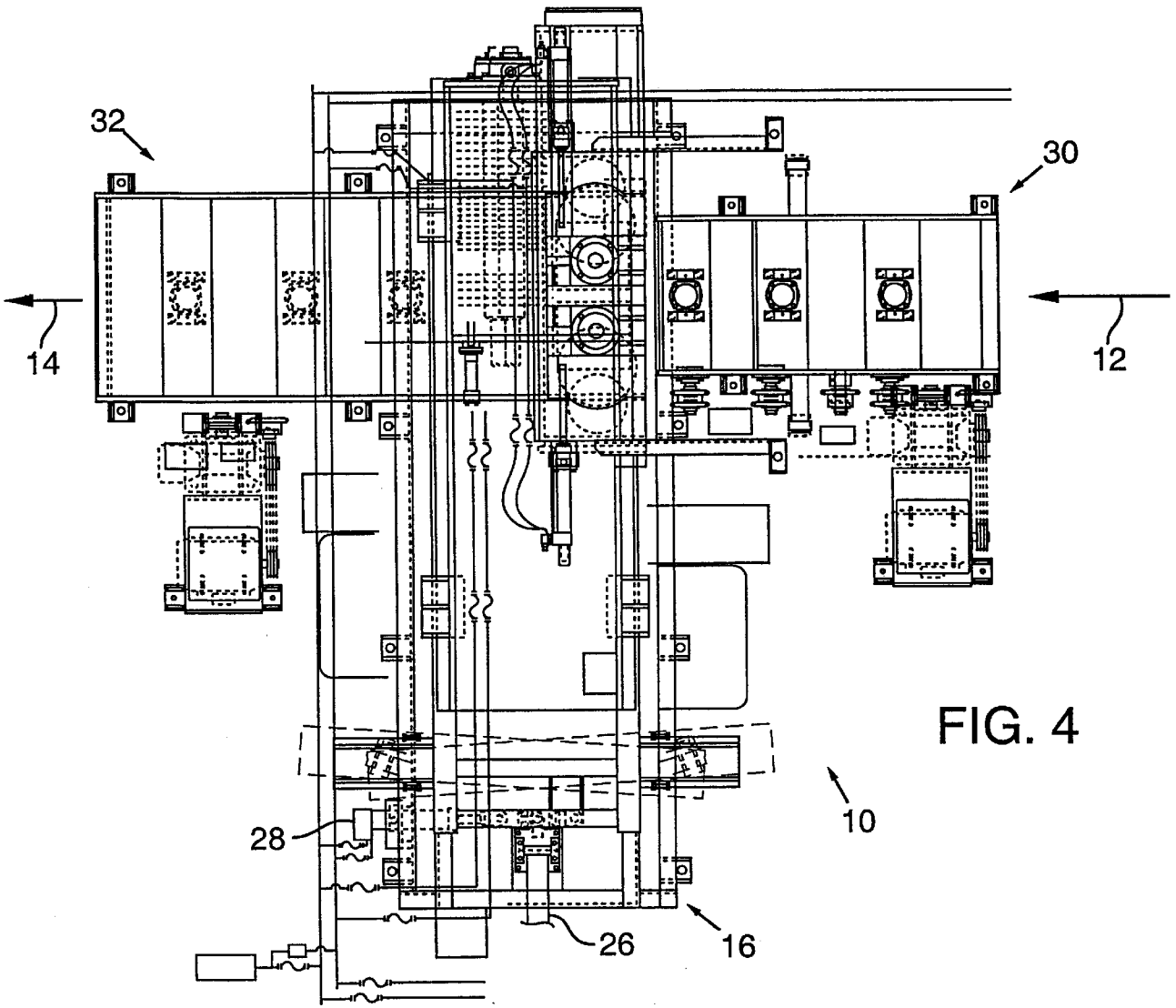
FIG. 4 is a top plan view of the apparatus of FIG. 3 in which the in-feed conveyor is also shown.

Column 2,
Line 48, "FIG. 3" should read -- FIGS. 1-3 --

Column 3,
Line 8, "that the can" should read -- that they can --
Line 20, "about a vertical" should read -- about vertical --

Signed and Sealed this

Nineteenth Day of March, 2002

*Attest:*

*Attesting Officer*

JAMES E. ROGAN
*Director of the United States Patent and Trademark Office*